US006305828B1

(12) United States Patent
Huang

(10) Patent No.: US 6,305,828 B1
(45) Date of Patent: Oct. 23, 2001

(54) CHRISTMAS LAMP BASE

(76) Inventor: Shun-Feng Huang, No. 13, Lane 84, Nei Hu Road, Hsin Chu City (TW)

( * ) Notice: Subject to any disclaimer, the term of this patent is extended or adjusted under 35 U.S.C. 154(b) by 0 days.

(21) Appl. No.: 09/624,036

(22) Filed: Jul. 24, 2000

(51) Int. Cl.[7] ..... F21V 21/00
(52) U.S. Cl. ..... 362/391; 362/226; 362/249; 362/396; 362/806
(58) Field of Search ..... 362/226, 249, 362/396, 391, 806

(56) References Cited

U.S. PATENT DOCUMENTS 5,228,774 * 7/1993 Liao ..... 362/391
5,531,411 * 7/1996 Adams ..... 362/391
5,954,425 * 9/1999 Lin ..... 362/391

* cited by examiner

*Primary Examiner*—Stephen Husar
(74) *Attorney, Agent, or Firm*—Rosenberg, Klein & Lee

(57) ABSTRACT

A Christmas lamp base includes a socket, a bottom part and a hooked part which are separable parts, and each can be made according to various designs. The socket has a separating plate between an upper and a lower part. The separating plate has two connecting holes. The hooked part is provided for permitting the lamp to be hung on a Christmas tree, and has a connecting portion and a curved hanging portion. The hooked part is connected to the socket by inserting the connecting portion into a slot on the socket. The bottom part has two connecting protrusions projecting on a bottom cover. The bottom part is connected to the socket with the protrusions each passed through a respective one of the connecting holes of the socket. The design of the Christmas lamp can be changed by replacing one of the parts with other designs, not having to make another mould for the whole lamp base.

6 Claims, 5 Drawing Sheets

CHRISTMAS LAMP BASE

BACKGROUND OF THE INVENTION

The present invention relates to a Christmas lamp base, and particularly to one which includes several separable parts such that the design of the Christmas lamp base cab be easily changed by changing the design of one or more of the parts.

Referring to FIG. 7, a conventional Christmas lamp base includes a socket 10 and a hooked member 20. The socket 10 has a through hole 107 on a lower part. A cord 40 is passed through the through hole for connecting the lamp to supply of electricity. The socket 10 yet has a trench 106, through holes 102 and 103, and a threaded portion on an inner side. The trench 106 communicates with the through hole 102. A first conducting chip 104 is received in the trench 106, and passed through the through hole 102 to electrically connect the cord 40. A second conducting 105 is passed through the hole 103 to electrically connect the cord 40. A bulb 30 is connected to the threaded portion 101, and contact the conducting chips 104, 105.

The hooked member 20 projects on a lateral side of the socket 10. The hooked member 20 has several engaging teeth 201, a curved hanging portion 202 and several engaging protrusions 203. The Christmas lamp can be hung on a Christmas tree, wire, on a fence from the engaging teeth 201 or the curved hanging portion 202.

However, the lamp base in found to have disadvantages as follows.

1. The lamp base is made as a whole body without separable parts so the manufacturers have to make another mould if they want to change the design of the lamp base, ever slightly. Consequently, the manufacturing cost is relatively high.

2. When the lamp is hung on a wire from the curved hanging portion 202, it is likely to fall off the wire because there is no stopping means at the open end of the curved portion.

SUMMARY OF THE INVENTION

Therefore, it is a main object of the present invention to provide a Christmas lamp base, which consists of several separable components. The parts can be made to have various designs, and the lamp base can be made by putting the desired parts together according to the customers' need.

It is another object of the present invention to provide a Christmas lamp base which can be hung on a Christmas tree or a wire firmly.

The lamp base of the present invention includes:

- a socket; the socket having a separating plate between an upper and a lower arts thereof; the socket receiving a bulb on the upper part; the socket having a trench on a lower part provided for locating a cord; the separating plate having two connecting holes;
- a hooked part; the hooked part having a connecting portion and a curved hanging potion; the connecting portion of the hooked part being connected to the socket from a lateral slot of the socket;
- a bottom part, the bottom part having a bottom cover and two connecting protrusions; the bottom part being connected to the socket with the protrusions each passed through a respective one of the connecting hole of the separating plate; a first one of the connecting protrusions having two gaps engaging two engaging teeth of the connecting portion of the hooked part.

Because the parts of the lamp base are separable, the manufacturer doesn't have to make a new mould of the whole lamp base when he needs to change the design. He only has to replace one or more of the parts with others having different designs.

BRIEF DESCRIPTION OF THE DRAWINGS

The present invention will be better understood by reference to the accompanying drawings, wherein.

DESCRIPTION OF THE PREFERRED EMBODIMENTS

Figure 1:
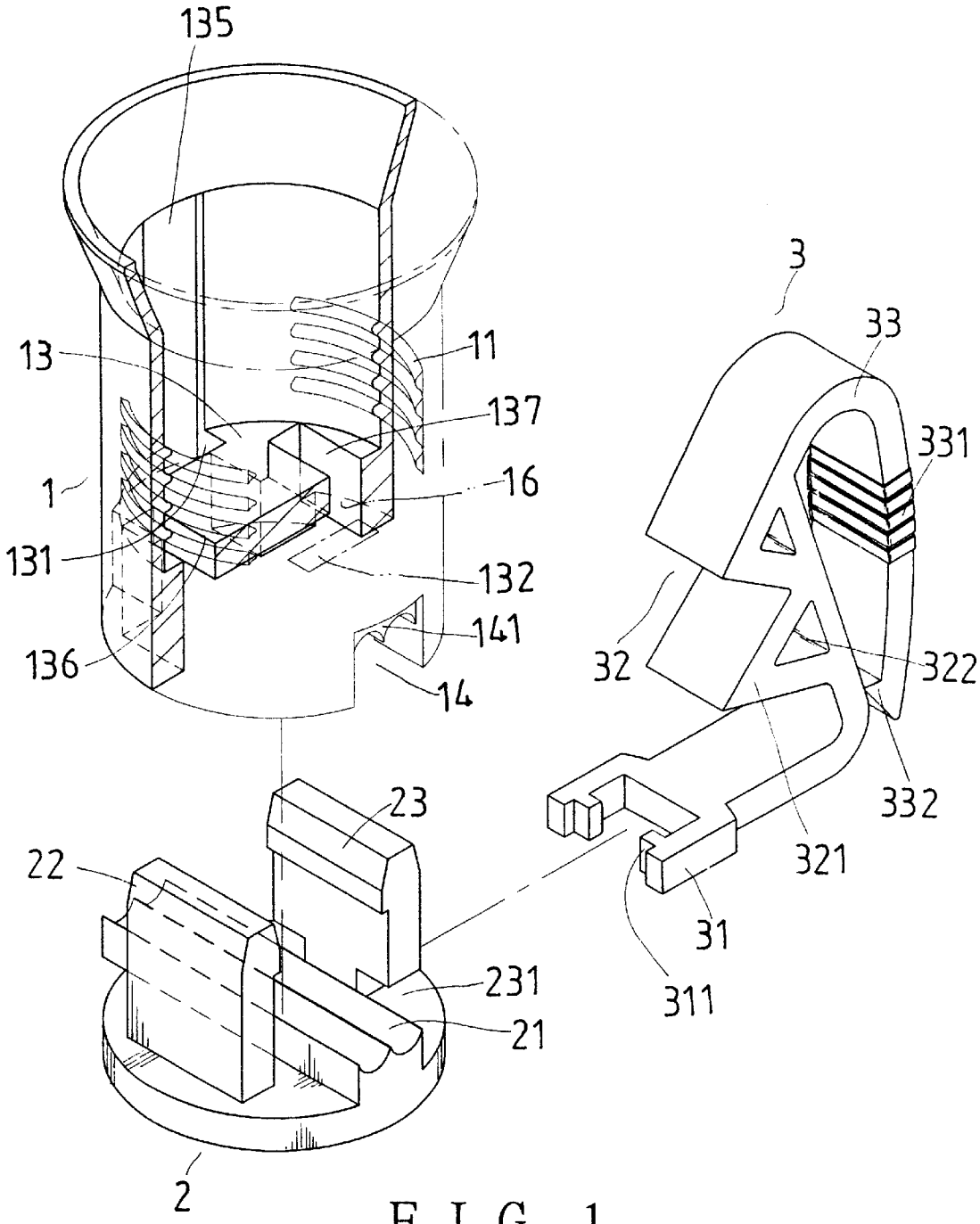
FIG. 1 is an exploded perspective view of the lamp base of the present invention.
Figure 2:
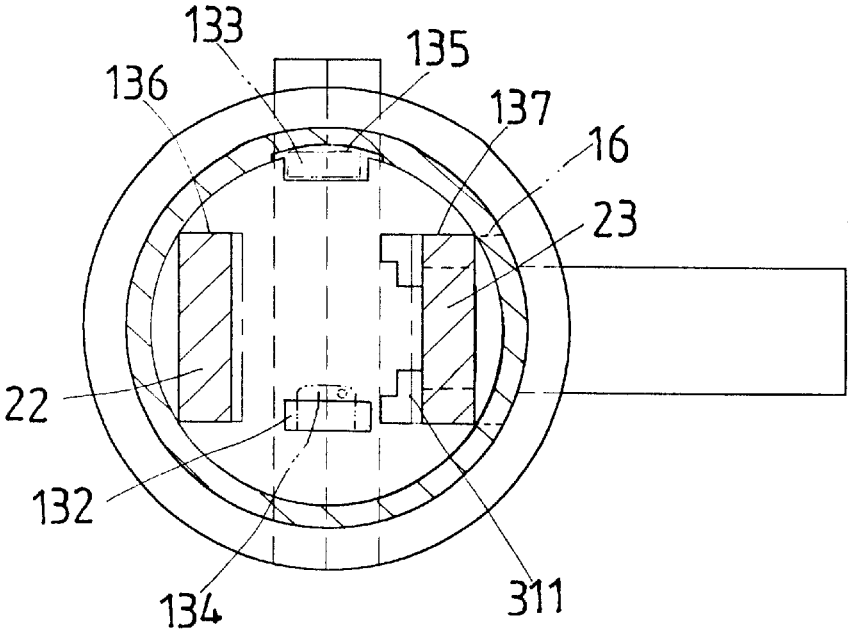
FIG. 2 is a cross-sectional view of the lamp base of the present invention.
Figure 3:
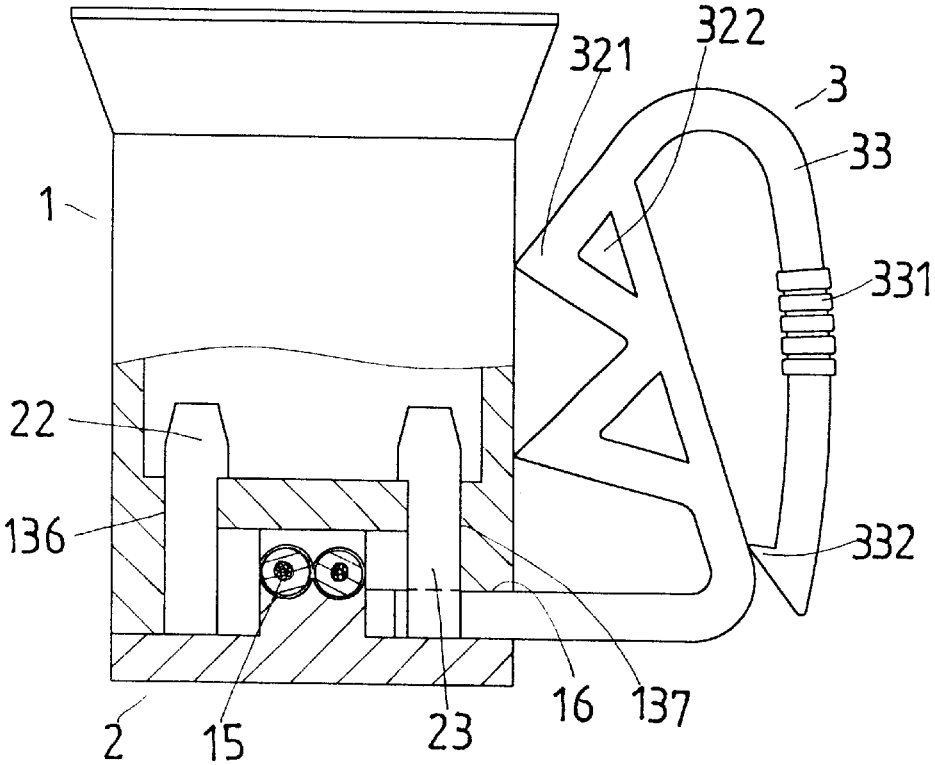
FIG. 3 is another cross-sectional view of the lamp base of the present invention.

Referring to FIGS. 1, 2 and 3, a Christmas lamp base of the present invention includes a socket 1, a bottom part 2 and a hooked part 3.

The socket 1 has a threaded portion 11 on an inner side, a separating late 13 and a holding trench 14. The separating plate 13 is disposed between the threaded portion 11 and the trench 14. The socket 1 further has a trench 135 on the inner side.

The separating plate 13 has through holes 131, 132. The through hole 131 is in open communication with the trench 135. A first conducting chip 133 is received in the trench 135, and passed through the through hole 131. A second conducting chip 134 is passed through the hole 132.

The socket 1 further has a slot 16 on a lateral side. The separating plate 13 yet has connecting holes 136, 137. A locating protrusion 141 is disposed in the holding trench 14; the locating trench 141 help locate a cord 15 passed through the holding trench 14.

The bottom part 2 has a bottom cover part (not numbered), two connecting protrusions 22, 23 projecting on the bottom cover part, and a locating part 21 on the cover part. The bottom part 2 is connected to the lower end of the socket 1 with the connecting protrusions 22, 23 passing through a respective one of the connecting holes 136, 137 and engaging the separating plate 13 to prevent the bottom part 2 from falling off. The locating part 21 also has a protrusion (not numbered) shaped like the locating protrusion 141. Thus, the cord 15 can be located in the holding trench 14 between the locating part 21 and the protrusion 141. The connecting protrusion 23 has two engaging gaps 231 on two sides thereof The hooked part 3 has a connecting portion 31, a toothed portion 32, a curved hanging portion 33 and a stopping teeth 332 on an outer end of the curved hanging portion 33. The connecting portion 31 has two engaging teeth 311 facing each other.

The toothed portion 32 has several teeth 321; the teeth 321 each has a through hole 322 for permitting connecting wires to be passed therethrough.

The curved hanging portion 33 further has rough portion 331 for helping the hooked part 3 hang on a thing more firmly.

The hooked part 3 is connected to the socket 1 by inserting the connecting portion 31 through the slot 16 of the socket 1; the engaging teeth 31 will engage the engaging gaps 231 of the bottom part 2. Thus, the hooked part 3 is firmly connected to the socket 1 and the bottom part 2.

A bulb 12 is connected to the threaded portion 11 of the socket 1 and the conducting chips 133, 134. The conducting chips 133, 134 are electrically connected to the cord 15. Thus, the bulb 12 is connected to supply of electricity.

Figure 5:
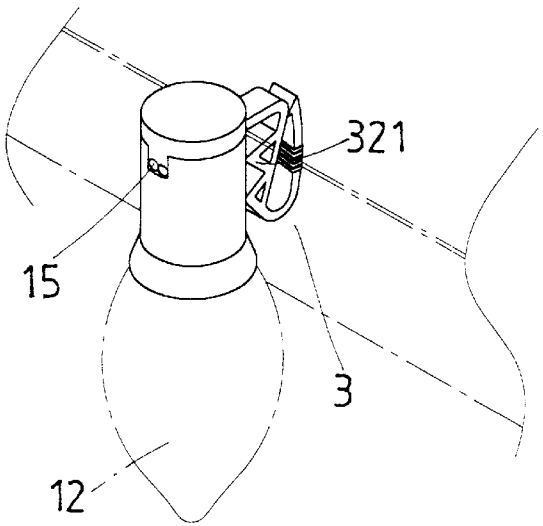
FIG. 5 is a view showing the Christmas lamp being hung on a wire according to the present invention.
Figure 4:
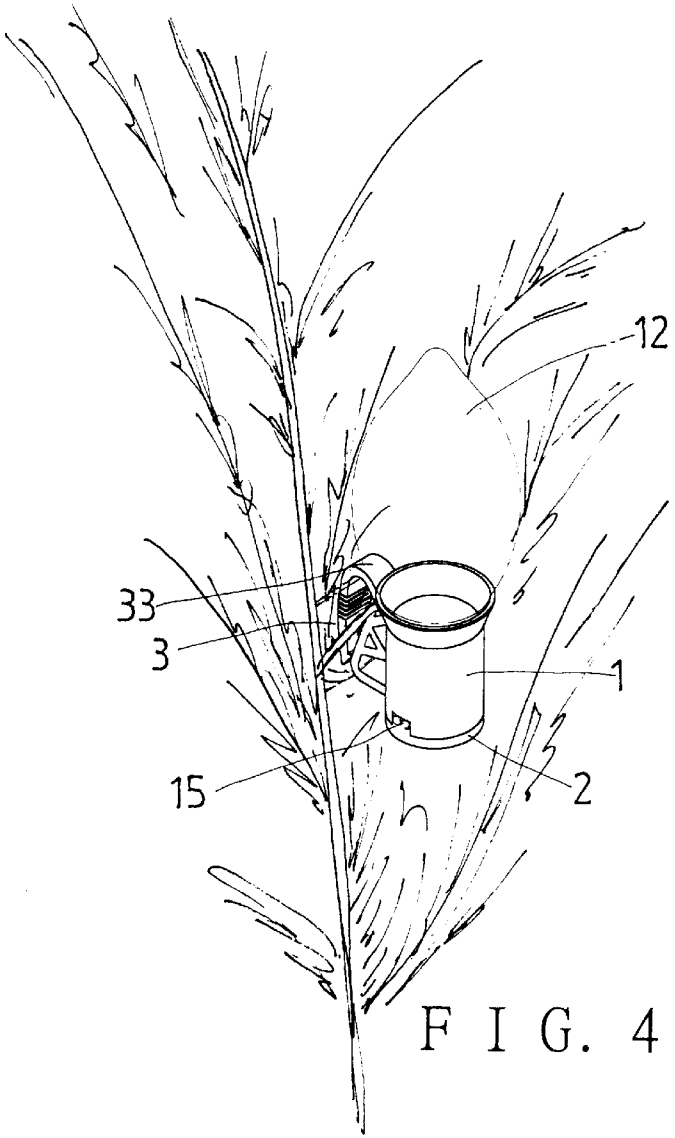
FIG. 4 is a view showing the Christmas lamp being hung on a tree according to the present invention.
Figure 6:
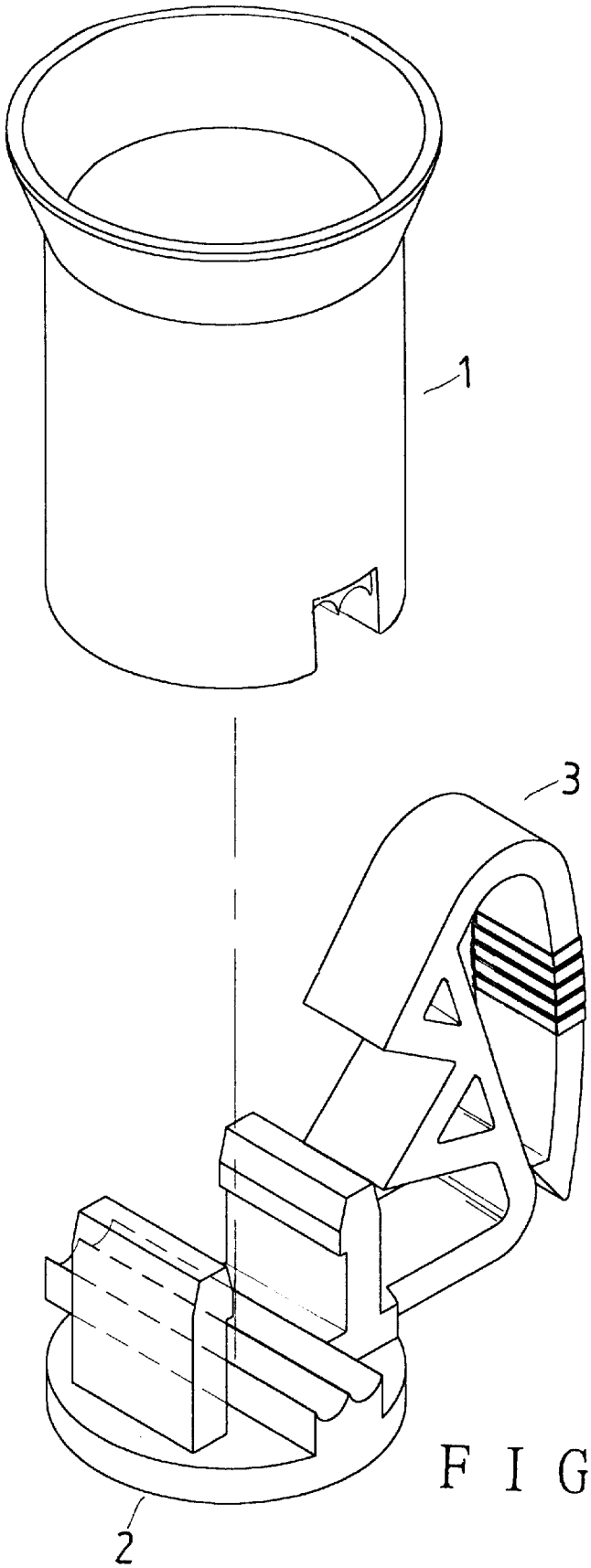
FIG. 6 is a view of the lamp base according to a second embodiment of present invention.
Figure 7:
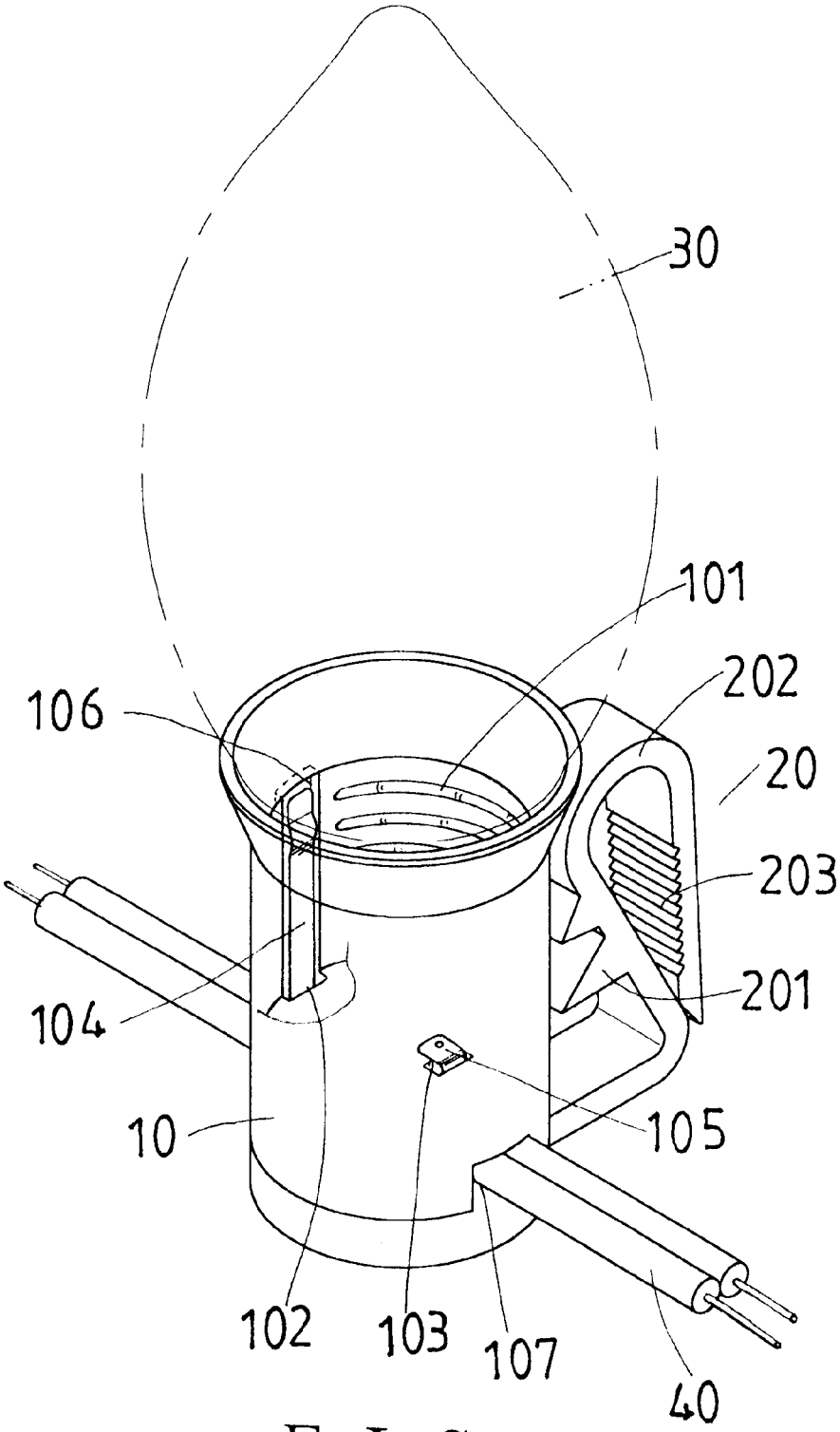
F I G. 7 (PRIOR ART)
FIG. 7 is a perspective view of the conventional lamp base according the Background.

In using the Christmas lamp, referring to FIGS. 4 and 5, the user can hang the lamp on a Christmas tree, wires or a fence from the toothed portion 32 or the curved hanging portion 33 of the hooked part 3 according to his need. When the lamp is hung from the curved hanging portion 33, the stopping teeth 332 can prevent the lamp from falling off In a second embodiment of the present invention, referring to FIG. 6, the hooked part and the bottom part are made to be a whole body.

From the above description, the Christmas lamp base of the present invention can be known to have desirable features as follows.

1. The lamp base consists of the socket, the bottom part and the hooked part which are separable. So, the design of a lamp base can be changed without having to make a new mould for a whole lamp base. And, the manufacturer can make the separate parts with various design and combine them according to need; thus, the cost of changing design is lower than the conventional one.

2. The stopping teeth of the hooked part can prevent the lamp from falling off.

3. The rough portion of the curved hanging portion can help the user hold the hanging portion firmly in hanging the lamp to a Christmas tree.

What is claimed is:

1. A Christmas lamp base, comprising a socket; said socket having an upper part provided for receiving a bulb therein, said socket having a holding trench on a lower part and a separating plate between said upper part and said lower part; said separating plate having two connecting holes; said socket having a slot on a lateral side thereof; said socket having two conducting chips received therein; said chips being passed through said separating plate and communicating with said holding trench; a hooked part; said hooked part having a connecting portion and a curved hanging portion; said hooked part being connected to said socket with said connecting portion passed through said slot of said socket;

a bottom part; said bottom part having a bottom cover, two connecting protrusions projecting on said bottom cover and a locating part on said cover; said bottom part being coupled to said socket with said connecting protrusions passed through a respective one of said connecting holes of said socket, and with a first one of said connecting protrusions connected to said connecting portion of said hooked part; said locating part being received in said holding trench for locating a cord in said trench.

2. The Christmas lamp base as claimed in claim 1, wherein said hooked part and said bottom part are made to be a whole body.

3. The Christmas lamp base as claimed in claim 1, wherein said connecting portion has two engaging teeth facing each other, and said first connecting protrusion of said bottom part has two engaging gaps on two sides; said engaging teeth engaging a respective one of said gaps.

4. The Christmas lamp base as claimed in claim 1, wherein said hooked part has a toothed portion between said connecting portion and said curved hanging portion; said toothed portion having a plurality of teeth thereon; said teeth each having a through hole thereon.

5. The Christmas lamp base as claimed in claim 1, wherein said curved hanging portion having a rough portion thereon for helping a user to hold firmly.

6. The Christmas lamp base as claimed in claim 1, wherein said curved hanging portion has a stopping teeth at an outer end thereof.

* * * * *